United States Patent [19]

Lundqvist

[11] 4,144,982

[45] Mar. 20, 1979

[54] DEVICE AT FORK-EQUIPPED MACHINE

[75] Inventor: Gunnar Lundqvist, Skelleftea, Sweden

[73] Assignee: AB Holmbom & Hedlund, Sweden

[21] Appl. No.: 583,524

[22] Filed: Jun. 4, 1975

[51] Int. Cl.[2] ..... B66F 7/28; B66F 9/06

[52] U.S. Cl. ..... 414/666

[58] Field of Search ..... 214/730–731, 214/750, 16.4 A, 768, 701 Q; 108/121, 124, 129, 132

[56] References Cited

U.S. PATENT DOCUMENTS

| | | | |
|---|---|---|---|
| 2,721,668 | 10/1955 | Elsner | 214/731 |
| 3,010,595 | 11/1961 | Stone | 214/701 Q |
| 3,024,933 | 3/1962 | Albert et al. | 214/701 Q |
| 3,266,650 | 8/1966 | Hauschild et al. | 214/731 X |
| 3,672,525 | 6/1972 | Schaedler | 214/674 |
| 3,866,780 | 2/1975 | Miller et al. | 214/731 X |

FOREIGN PATENT DOCUMENTS

| | | | |
|---|---|---|---|
| 1179513 | 10/1964 | Fed. Rep. of Germany | 214/16.4 A |
| 775950 | 1/1935 | France | 108/129 |

*Primary Examiner*—Francis S. Husar
*Assistant Examiner*—R. B. Johnson
*Attorney, Agent, or Firm*—Burns, Doane, Swecker & Mathis

[57] ABSTRACT

A fork lift frame that supports a pair of forks. Each fork has a vertical portion and a load supporting horizontal portion. A hinge assembly is attached to the vertical portion of each fork at an acute angle relative to the vertical portion of the forks so that the horizontal portion of the forks can be positioned across the front of the frame in a vertically spaced position when they are not in use.

2 Claims, 5 Drawing Figures

DEVICE AT FORK-EQUIPPED MACHINE

This invention relates generally to a fork lift truck having a frame supporting a pair of fork legs, each fork leg having a substantially vertical leg portion and each fork leg being laterally pivotal about an axle.

BRIEF SUMMARY OF THE INVENTION

In all commercially available fork lift trucks and other machines equipped with a load carrying and/or lifting fork, as known, the fork legs are arranged projecting in the driving direction and thereby constitute a great traffic danger, particularly when the trucks or machines are moved on roads without carrying any load, because the forks undoubtedly will act as a spear when a machine equipped with forks collides with a vehicle or person, as it unfortunately has happened with a tragic end at several occasions. As such fork-equipped machines increase in number, not only in industrial areas and on building sites but also on public roads and other places with dense traffic, the danger of the projecting fork legs for the traffic increases, too.

In order to solve this problem, the present invention has the object to provide fork trucks and other fork-equipped machines with a device so designed as to render it possible so to pivot the fork legs aside for the transport of the truck or machine, that such vehicles can be moved so as if they were not equipped with a fork. The device, furthermore, should be of such a nature as to render possible a rapid return motion of the fork legs to their original position when the fork is to be applied for its intended purpose. This object is achieved thereby that the device according to the invention shows the characterizing features defined in the claims.

Figure 1:
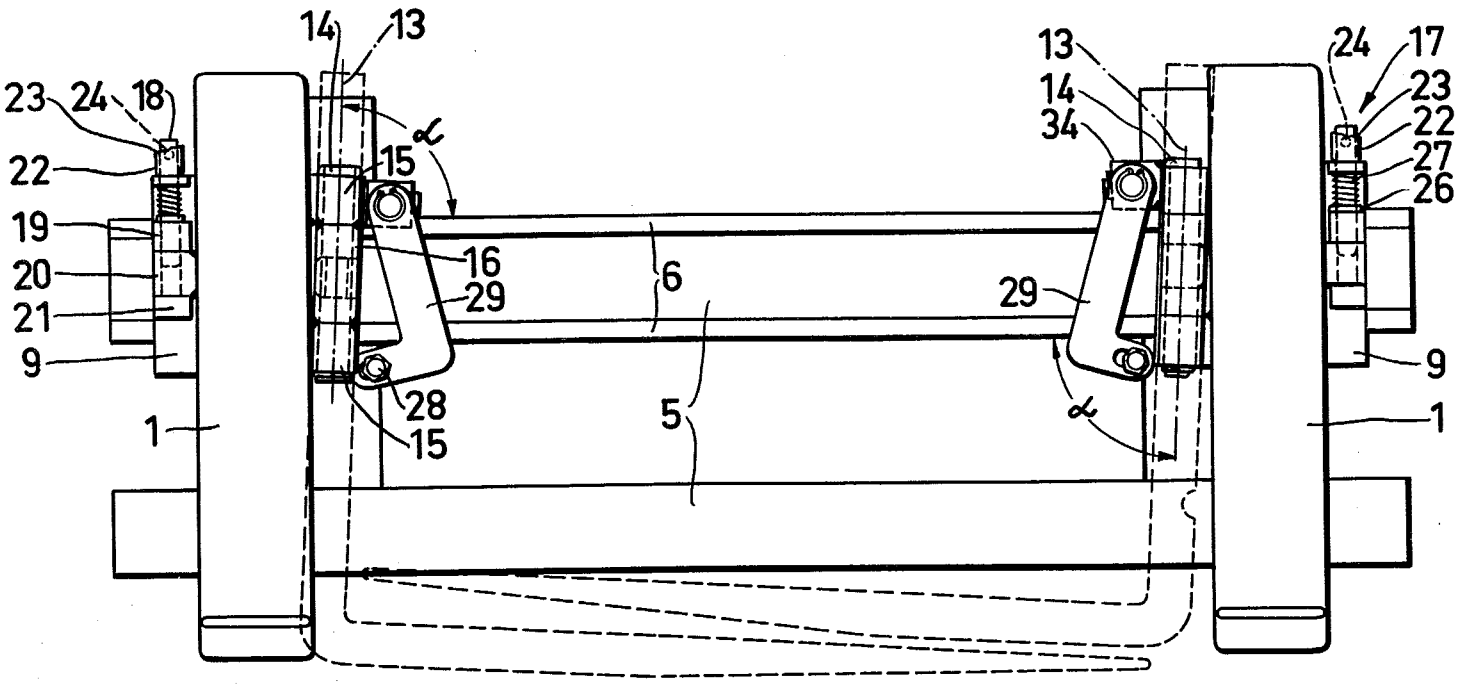
Figure 2:
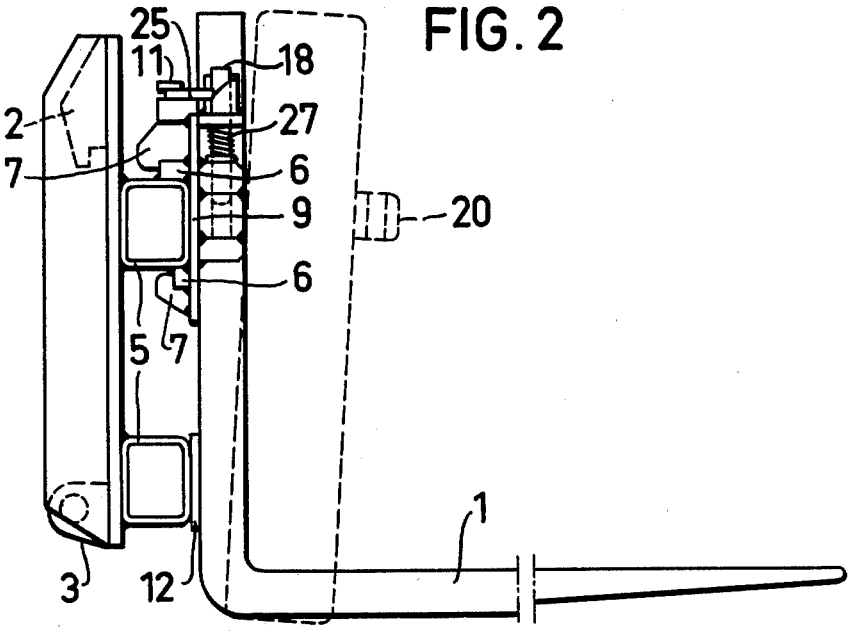
Figure 4:
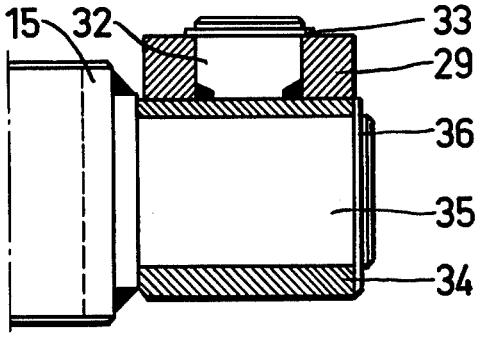
Figure 5:
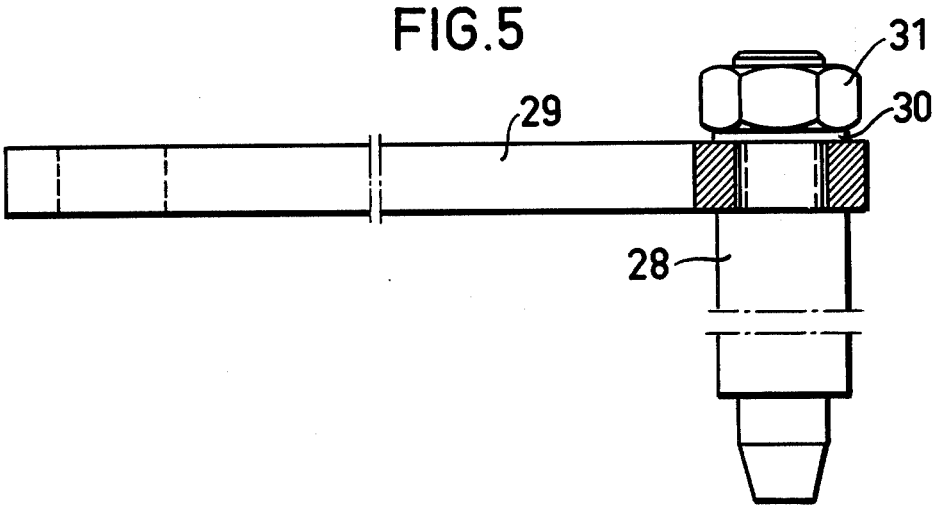
Figure 3:
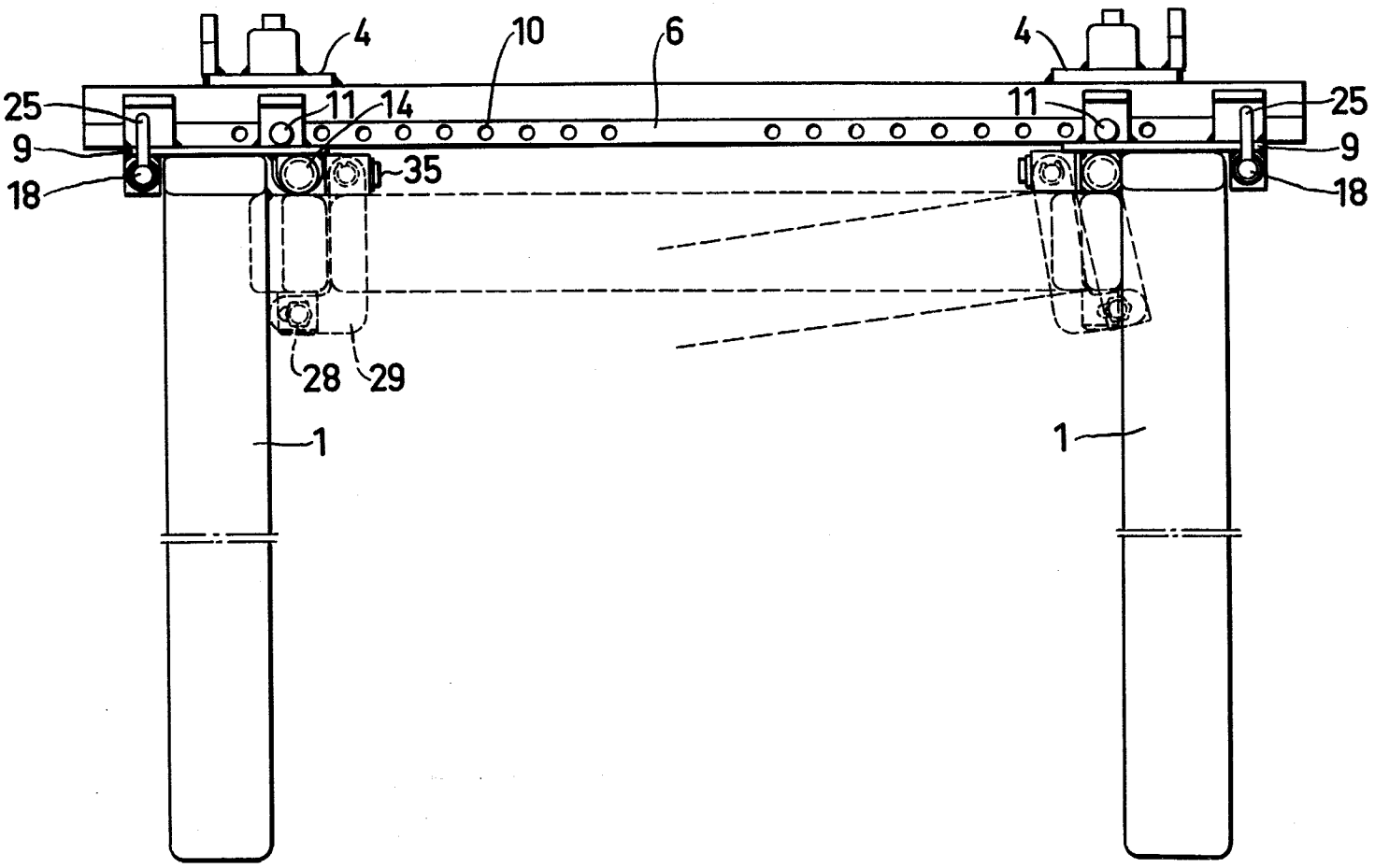

The invention is described in the following in greater detail, with reference to the accompanying drawings, in which FIG. 1 is a front view, FIG. 2 is an end view, FIG. 3 is a plane view of the device according to the invention, and FIGS. 4 and 5 show certain details of the device on an enlarged scale.

The invention is shown in the drawing in connection with a fork frame comprising two fork legs 1 which is intended to be coupled together with a loading machine by means of conventional fastening members 2 and 3 disposed on the vertical portions 4 of the frame. Said portions are interconnected by two horizontal frame beams 5, of which the upper beam is provided on its upper and lower side with guide bars 6 for hook-shaped grip members 7 grabbing about the respective guide bar 6 so as to movably retain one fork leg 1 on the frame in vertical position, as shown by fully drawn lines in FIGS. 1–3. Instead of being directly connected with a fork leg, as is the case with the known arrangements of this kind, the hook-shaped members 7 at the present invention are fastened on a guide plate 9, one for each fork leg 1, which plate is movable along the frame beams 5 for setting the distance between the fork legs. In order to render the fork legs lockable in different positions, the upper guide bar 6 is provided with a hole 10 for a pin 11, which is supported on one of the upper hook-shaped members on each guide plate 9.

Each such guide plate 9, thus, carries a fork leg 1, which abuts the lower frame beam via an intermediate piece 12, which preferably is fastened on the fork leg 1, as shown in FIG. 2, and which should have about the same thickness as the guide plate 9.

According to the invention, each fork leg 1 is at its guide plate 9 supported pivotally about an axle 13 inclined with an angle $\alpha$ of less than 90° to a plane in parallel with the direction of motion of the fork legs and, therewith, with the guide bars 6. As appears especially from FIG. 1, the axles 13 of the fork legs shall be mutually inversely inclined to the same direction, but the angle $\alpha$ between the axle and said plane may be different for the two fork legs 1. Preferably, however, the two axles 13 in FIG. 1 are arranged in parallel with each other. The angle $\alpha$ between the two axles 13 and said plane is herewith so chosen that the fork legs can be pivoted inward to the fork frame without one leg being obstructed by the other and to a position in which the fork legs overlap each other, as shown by dashed lines in FIG. 1. In FIG. 2 there is indicated by dashed lines that one fork leg 1 is not entirely pivoted inward.

In the embodiment shown, each axle 13 consists of a link pin 14 in a hinge-joint, which comprises two sleeves 15 secured on the guide plate 9 and one sleeve 16 disposed between said two sleeves in alignment therewith and secured on the fork leg 1. In order to effect the desired inclination, the upper sleeve 15 in the hinge for the left-hand fork leg in FIG. 4 is positioned at a greater distance from the fork leg than the lower sleeve 15 of the hinge, while the upper sleeve 1 in the hinge for the right-hand hinge in FIG. 1 is positioned closer to the fork leg than the lower hinge sleeve 15.

In order to prevent unintentional inward pivoting of the fork legs 1, the legs are locked in their normal operative position by a locking means designated generally by 17. Said locking means comprises a locking split-pin 18, which in locking position extends downward through a locking lug 19 fastened on the guide plate 9, and into a hole in a locking lug 20 fastened on the fork, which lug 20 is supported on a shoulder 21 provided on the guide plate 9. The locking split-pin 18 is carried in a guide sleeve 22, which is fastened on the guide plate and provided with a lifting curve 23 having a locking position 24 for co-action with an arm 25 on the locking split-pin 18. Between the guide sleeve 22 and a collar 26 on the locking split-pin, a spring 27 is positioned trying to retain the locking split-pin in its locking position. By pivoting the arm 25 of the locking split-pin counter-clockwise, thus, the locking split-pin is lifted by the lifting curve 23 on the guide sleeve 22 against the action of the spring 27 and, thus, is released from the locking lug 20. The fork leg can thereafter be pivoted inward to the fork frame into the position indicated by dashed lines, in which position the fork point lies protected. In order to retain the locking split-pin in lifted position without obstructing the return motion of the fork leg to its operative position, said locking position 24 is provided in the guide sleeve 22.

When the fork leg pivots inward, thus, the locking lug 20 follows along and is in this position adapted, see FIGS. 2 and 3, to receive in its hole a locking pin 28 on a locking arm 29 to prevent unintentional return pivoting of the fork legs pivoted inward, for example at sudden braking or the like. The locking pin 28 is so positioned in an oblong hole in one end of the locking arm 29, that the pin has certain movability and thereby can easier be fitted into the hole of the locking lug. The pin 28 is retained at the locking arm 29 by means of a disk 30 and a nut 31, see FIG. 5. The locking arm 29 is pivotally mounted at its other end about a pin 32 and retained thereon by means of a disk 33. The pin 32 is positioned on a sleeve 34, which in its turn is positioned on a pin 35 provided on the upper hinge sleeve 15. The sleeve 34 is retained on the pin 35 by a locking disk 36. The locking arm 29, thus, is pivotal both about the pin 32 and the pin 35, thereby rendering it easy in inward pivoted position of the forks to place the locking pin 28 in the hole of the locking lug 20. The fork legs are thereby safely locked in inward pivoted position.

The present invention is not restricted to the embodiment described and shown, but can be varied and modified in many different ways within the scope of the invention conception as it is apparent from the claims. The invention is not restricted, either, to the field of application stated above, but can be applied also in other connections to solve problems of similar nature. It should further be pointed out that, for example, the locking arm 29 for locking the fork legs in inward pivoted position can be replaced by other means per se known without thereby affecting the invention.

What I claim is:

1. In a fork lift frame supporting a pair of fork legs, each of said fork legs having a substantially vertical portion and a horizontal load supporting portion, the improvement comprising a fork leg assembly for permitting said fork legs to fold aside across the front of said frame while not in use, said assembly including:

fork leg support means movably mounted on said frame;

a pair of hinge means cooperatively disposed on said support means and respectively attached to the vertical leg portion of each of said fork legs for laterally pivoting said fork legs about inclined axes, each of said hinge means including a link pin which defines one of said axes, said hinge means being laterally offset from the vertical leg portions of the fork legs and located between said vertical leg portions such that said axes lie in a plane defined by said vertical leg portions, the axes of said hinge means being inclined at an acute angle relative to the substantially vertical leg portions of the fork legs with which they are associated and in parallel relationship with each other whereby said fork legs may be folded across the front of the truck without hitting one another;

first locking means cooperatively disposed on said support means and each of said fork legs for holding each fork leg in a forwardly projecting load supporting position; and, second locking means cooperatively disposed on said support means and each of said fork legs for holding each fork leg in said folded position.

2. A forklift assembly according to claim 1, wherein said first locking means includes a first locking lug affixed to each of said fork legs, second locking lugs affixed to said support means and split pins adapted for operative engagement in said first and second locking lugs for holding each of said fork legs in the forward position; and, said second locking means includes a locking arm pivotally supported on each of said hinge means for rotation about two generally orthogonal axes and a locking pin supported on one end of each of said locking arms adapted for engagement with the first locking lug on a fork leg when said fork leg has been pivoted to the folded position.

* * * * *